United States Patent [19]

Morimoto et al.

[11] Patent Number: 4,868,601

[45] Date of Patent: Sep. 19, 1989

[54] DEVELOPING UNIT FOR ELECTROPHOTOGRAPHY WITH TONER SENSOR

[75] Inventors: Kenichi Morimoto, Nara; Akiyoshi Fujihara, Tenri, both of Japan

[73] Assignee: Sharp Kabushiki Kaisha, Osaka, Japan

[21] Appl. No.: 160,137

[22] Filed: Feb. 25, 1988

[30] Foreign Application Priority Data

Feb. 25, 1987 [JP] Japan ..... 62-43475

[51] Int. Cl.[4] ..... G03G 15/00; G03G 15/09; B05C 11/00

[52] U.S. Cl. ..... 355/208; 118/658; 118/689; 355/246; 355/251

[58] Field of Search ..... 355/3 DD, 14 D, 3 R; 118/658, 688, 689, 690, 691

[56] References Cited

U.S. PATENT DOCUMENTS 4,660,505 4/1987 Goto et al. ..... 118/689

FOREIGN PATENT DOCUMENTS 232375 12/1984 Japan ..... 355/14 D
220375 11/1985 Japan ..... 355/3 D D
158357 7/1986 Japan ..... 355/14 D

*Primary Examiner*—Grimley, A. T.
*Assistant Examiner*—Edward Pipala
*Attorney, Agent, or Firm*—Flehr, Hohbach, Test, Albritton & Herbert

[57] ABSTRACT

A developing unit for electrophotography has a magnet roller disposed opposite to its photosensitive drum and a toner sensor disposed near the magnet roller and displaced from the position of one of the poles of the magnet roller by 5–15° in the direction of the photosensitive drum.

2 Claims, 2 Drawing Sheets

DEVELOPING UNIT FOR ELECTROPHOTOGRAPHY WITH TONER SENSOR

BACKGROUND OF THE INVENTION

This invention relates to a developing unit used in electrophotography and more particularly to such a developing unit comprised of a magnet roller disposed opposite to a photosensitive drum, a doctor blade for controlling the amount of developer adsorbed on this magnet roller and a toner sensor for measuring toner concentration.

Most developing units for electrophotography use a two-component developing agent. In this case, it is necessary to keep a constant ratio between its toner and carrier concentrations and to uniformize the toner concentration in the developer so that the quality of the obtained prints can be maintained at a high level. If the toner concentration is too low, the print density may become insufficient and the excess carrier may fall from the developing tank. If the toner concentration is too high, on the other hand, the excess toner may scatter around inside the tank to affect the print quality.

The toner concentration in the developing tank is determined by indirectly measuring the amount of the carrier in unit volume by the change in magnetic permeability. A device used for such a measurement is called a toner sensor and is adapted to detect changes in the magnetic flux in the neighborhood of a coil caused by variations in the amount of the carrier containing iron. Such a sensor is not sufficiently sensitive and cannot measure the desired concentration accurately if it is not in contact with the developing agent. If it is buried inside the agent, however, it tends to obstruct its stirring motion.

SUMMARY OF THE INVENTION

It is therefore an object of the present invention to eliminate these drawbacks of prior art developing units by providing an improved developing unit for electrophotography which does not obstruct the stirring motion of the developing agent but can accurately measure the toner concentration such that toner control can be effected dependably.

The above and other objects of the present invention are achieved by providing a developing unit which is not only comprised of a magnet roller disposed opposite to a photosensitive drum, a doctor blade for uniformly regulating the amount of the developing agent adsorbed on this magnet roller and a toner sensor for detecting the toner concentration, but also is characterized as having the toner sensor disposed slightly away from a position exactly opposite to a magnetic pole of the magnet roller in the direction of the photosensitive drum.

The photosensitive drum and the magnet roller rotate in mutually opposite directions. The thickness of the layer of the developing agent adsorbed on the magnet roller is regulated by the doctor blade and the developing agent on the magnet roller comes into contact first with the photosensitive drum and then with the sensing surface of the toner sensor. The toner sensor measures the toner concentration and if the measured level of concentration is not sufficiently high, a signal is transmitted to start a motor to turn a supply roller inside a toner cartridge, thereby causing the toner therein to be supplied into the developing tank.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
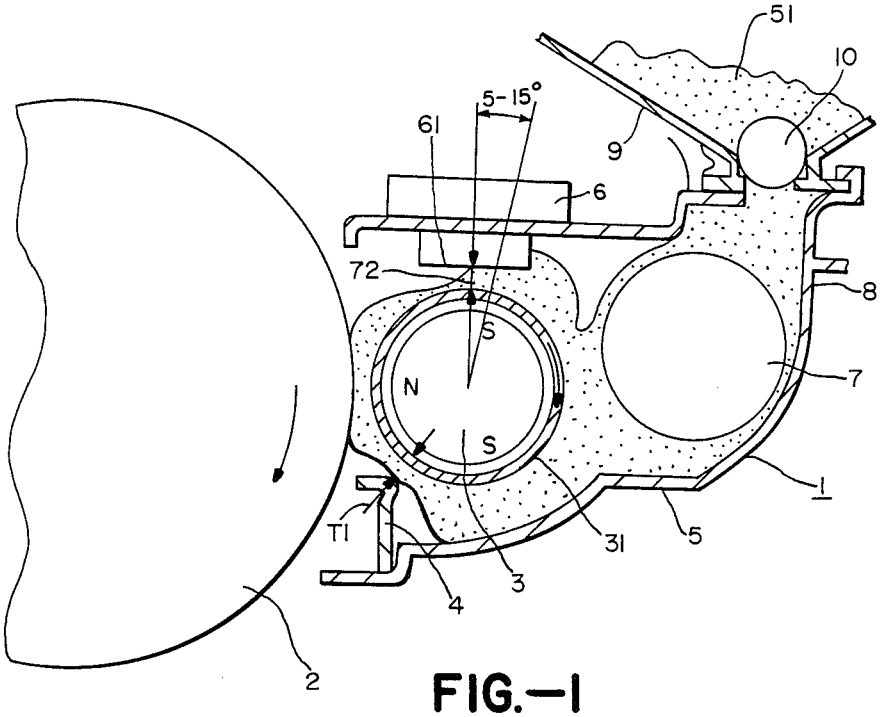
FIG. 1 is a schematic drawing showing the structure of a developing unit embodying the present invention.

In FIG. 1 which shows the structure of a developing unit 1 for electrophotography embodying the present invention, numeral 2 indicates a photosensitive drum and numeral 3 indicates a magnet roller, or a core portion thereof, which is disposed opposite to the photosensitive drum 2. The magnet roller 3 is of a known type with a sleeve 31 rotating around it and the core has one north (N) pole opposite from the photosensitive drum 2 and two south (S) poles, one of the south poles being at an upper part and the other at a lower part as shown in the figure. Numeral 4 indicates a doctor blade for controlling the thickness of the layer of developing agent 5 adsorbed on the surface of the rotating sleeve 31 of the magnet roller 3 as it moves adjacent to the photosensitive drum 2 and numeral 6 indicates a toner sensor with a sensor surface 61 for measuring the toner concentration in the developing agent 5. The sensor surface 61 is disposed near the sleeve 31 and slightly displaced from the position of the upper south pole of the magnet roller 3 in the direction of the photosensitive drum 2, that is, against the direction of rotation of the sleeve 31. The angular displacement of the sensor surface 61 from this south pole is about 5°–15° such that the sensor surface 61 will be sure to contact the developing agent 5 adsorbed on the sleeve 31 without obstructing the stirring motion of the developing agent 5. Numeral 8 indicates a developing tank, numeral 9 indicates a toner cartridge containing toner 51 and disposed above the developing tank 8, numeral 10 indicates a supply roller for causing the toner 51 inside the cartridge 9 to be supplied into the tank 8 in response to a command signal from the toner sensor 6, and numeral 7 indicates a stirrer roller for mixing the toner 51 thoroughly with the carrier of the developing agent 5. As the sleeve 31 rotates in the direction indicated by the associated arrow, a portion of the developing agent 5 attracted to the sleeve 31 by the lower south pole has its thickness controlled by the doctor blade 4 and, when it comes to the position facing the photosensitive drum 2 and hence opposite to the north pole of the magnet roller 3, only the toner component of the developing agent 5 becomes adsorbed onto the photosensitive drum 2. As the sleeve 31 rotates further, the developing agent 5 thereon comes to the position of the sensor surface 61 of the toner sensor 6 and thereafter becomes attracted by the upper south pole of the magnet roller 3 and mixed together by the stirrer roller 7 with a fresh supply of developing agent of which the toner component has not been consumed.

Figure 2:
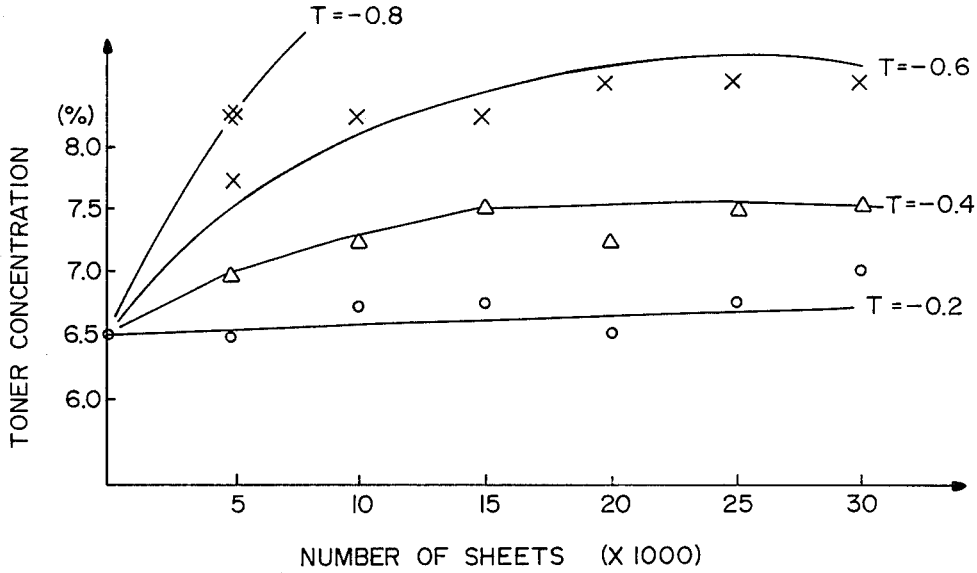
FIG. 2 is a graph showing how the toner concentration changes as developing unit of FIG. 1 is operated.

The toner sensor 6, in the meantime, measures the toner concentration in the developing agent 5 in contact with the sensor surface 61 and if the measured toner concentration is below a predetermined critical level, a command signal is transmitted to a toner motor (not shown) to cause the supply roller 10 for the cartridge 9 to rotate and to thereby cause the toner 51 in the cartridge 9 to be supplied into the developing tank 8 such that the toner concentration inside the tank 8 remains at a constant level. Since the toner sensor 6 is adapted to measure the toner concentration of the developing agent where its sensor surface 61 contacts the layer of developing agent on the sleeve 31, the measured value by the toner sensor 6 does not necessarily represent the overall toner concentration of the developing agent 5 inside the tank. In general, the measured value by the sensor 6 depends on its position and also on the distance $T_1$ between the doctor blade 4 and the sleeve 31 of the magnetic roller 3 (which is referred to as the doctor gap) and the distance $T_2$ between the toner sensor 6 and the sleeve 31. If the measured value is lower than the true toner concentration, the sensor 6 may transmit a command signal to cause a new supply of the toner 51 to be added into the developing agent 5 inside the tank 8 although the overall toner concentration at that moment is such that no new supply of toner is required. In other words, there can be situations where the toner concentration inside the tank 8 increases because the toner sensor 6 is not properly placed. FIG. 2 shows how this increase in the overall toner concentration occurs as many prints are made by this developing unit. In the figure, $T=T_2-T_1$ is used as a parameter. FIG. 2 shows that the toner concentration changes by 1% as T is changed by 0.2 mm. One also learns from FIG. 2 that the toner sensor 6 ceases to be able to measure the toner concentration correctly if the absolute value of T exceeds 0.6 mm. If $-T$ becomes too large, or if $T_2$ is too small with respect to $T_1$, this means that the sensor 6 is too close to the magnet roller 3 and the developing agent adsorbed on the sleeve 31 cannot freely pass by the sensor surface 61. In such a situation, the sensor surface 61 stays for a longer period of time in contact with the portion of the developing agent of which toner has been consumed and hence keeps outputting the toner signal for a larger period than is necessary. This causes the supply roller 10 to rotate longer than necessary and the overall toner concentration inside the tank 8 increases unreasonably.

Figure 3:
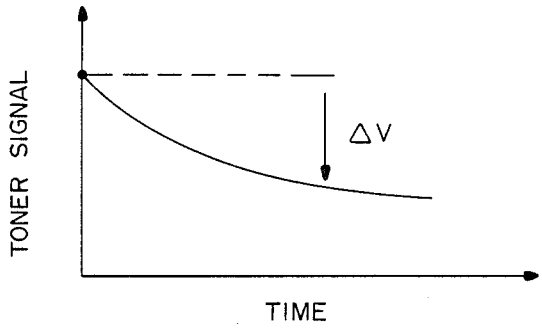
FIG. 3 is a graph schematically showing how the output voltage from the toner sensor of FIG. 1 drops as the developing agent is left stationary.
Figure 4:
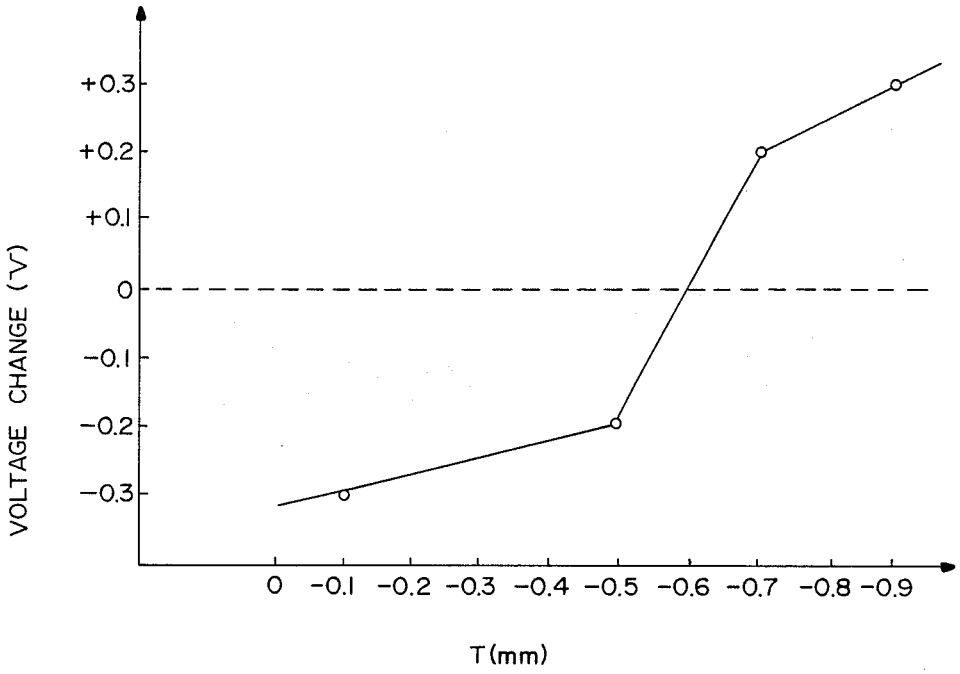
FIG. 4 is a graph schematically showing how the drop in the output voltage of the toner sensor is affected by its position with respect to the magnet roller.

If a portion of the developing agent 5 is left in a stationary condition for a long time, the corresponding output voltage from the toner sensor 6 changes as shown in FIG. 3. The greater the drop in the voltage, the more toner is added and hence the overall toner concentration rises. FIG. 4 shows the relationship between the value of T as defined above and the voltage drop. With reference simultaneously to FIGS. 2 and 4, since an excess toner concentration of about 1% results in a voltage change of $-0.3$ V, one may conclude that the minimum value of $-T$ is about 0. In other words, the toner sensor 6 must be disposed with respect to the magnet roller 3 such that T is within a range between 0 and $-6$ mm for a good toner control. The foregoing description of a preferred embodiment of the invention has been presented for purposes of illustration and description. It is not intended to be exhaustive or to limit the invention to the precise form disclosed, and many modifications and variations are possible in light of the above teaching. For example, the north and south poles of the magnet roller 3 may be interchanged. The numbers and positions of poles may be different. Any modifications and variations that may be apparent to a person skilled in the art are intended to be included within the scope of this invention.

What is claimed is:

1. In a developing unit for electrophotography including a magnet roller disposed opposite to a photosensitive drum, a doctor blade for controlling the amount of developing agent adsorbed on said magnet roller, and a toner sensor adapted to measure toner concentration, the improvement wherein said toner sensor is disposed at a position near said magnet roller and displaced from the position of a magnetic pole of said magnet roller 5–15° in the direction toward said photosensitive drum, the distance T defined by $T=T_2-T_1$ being between zero and $-0.6$ mm where $T_1$ is the separation between said magnet roller and said doctor blade and $T_2$ is the separation between said toner sensor and said magnet roller.

2. The developing unit of claim 1 wherein said magnet roller comprises two south poles and one north pole.

* * * * *